US006251686B1

(12) United States Patent
Studer et al.

(10) Patent No.: US 6,251,686 B1
(45) Date of Patent: Jun. 26, 2001

(54) LIQUID TRANSFER APPARATUS

(76) Inventors: Edward J. Studer; James E. Studer; Rita S. Harman, all of P.O. Drawer 739, Balinger, TX (US) 76821

( * ) Notice: Subject to any disclaimer, the term of this patent is extended or adjusted under 35 U.S.C. 154(b) by 0 days.

(21) Appl. No.: 09/031,080

(22) Filed: Feb. 26, 1998

(51) Int. Cl.[7] ..... B01L 9/06
(52) U.S. Cl. ..... 436/180; 422/104; 211/74
(58) Field of Search ..... 422/104, 99, 102; 211/74, 4; 435/284.1, 809; 436/180

(56) References Cited

U.S. PATENT DOCUMENTS

| | | | | |
|---|---|---|---|---|
| 3,778,232 | * | 12/1973 | McMorrow, Jr. | 211/74 |
| 4,938,369 | | 7/1990 | Carilli | 211/74 |
| 4,982,850 | | 1/1991 | Mears | 211/74 |
| 5,011,779 | * | 4/1991 | Maimon | 422/104 |
| 5,217,694 | | 6/1993 | Gibler et al. | 422/104 |
| 5,330,439 | * | 7/1994 | Jackson | 604/192 |
| 5,375,716 | | 12/1994 | Rubin et al. | 206/443 |
| 5,579,928 | | 12/1996 | Anukwuem | 211/74 |
| 5,579,929 | | 12/1996 | Schwartz | 211/74 |
| 5,616,301 | * | 4/1997 | Moser et al. | 422/104 |
| 5,624,404 | | 4/1997 | Fisler | 604/187 |
| 5,871,699 | * | 2/1999 | Ruggeri | 422/100 |

* cited by examiner

*Primary Examiner*—Robert J. Warden, Sr.
*Assistant Examiner*—Kaj K. Olsen
(74) *Attorney, Agent, or Firm*—Kilpatrick Stockton LLP

(57) ABSTRACT

A liquid transfer device for use in the safe transfer of fluids from a needle tipped syringe to at least one test tube. The device is equipped with a slidable top able to be removed from the device for placement of the test tubes into a carrier on the device. The top is provided with at least one guide hole aligned above the test tubes for directing the needle of the syringe into the test tube supported by the carrier. The top of the device is positioned below the top of the sides of the device thereby creating a protective lip for preventing errant needles from straying during use by a health care professional.

20 Claims, 7 Drawing Sheets

LIQUID TRANSFER APPARATUS

FIELD OF THE INVENTION

The present invention relates generally to a device for holding cylindrical work pieces, by way of example, conventionally formed test tubes. More specifically, the invention assists a health care worker in the care of patients while protecting the worker during the transfer of body fluids from a patient. The holder device is especially useful in the transfer of blood from a syringe to one or more test tubes as needed by a phlebotomist.

BACKGROUND OF THE INVENTION

Medical practice involving the diagnosis of various diseases normally requires the testing of various bodily fluids. These fluids are aspirated from a patient by use of a syringe with an attached hypodermic needle. After withdrawing the fluid, the needle is then inserted through a rubber stopper into a test tube. The fluid is then transferred from the syringe through the needle and into the test tube.

A real and constant safety problem is exposure of the health care professional to being inadvertently pierced or stuck by the needle when transferring the fluid from the patient to the test tube. This is especially critical for those transfers which occur outside the controlled conditions of a laboratory, such as during patient rounds by a phlebotomist or nurse. An accidental needle stick of the health care worker during the process of transferring fluids from the patient to the test tube exposes the worker to the same infection as that of the patient, requiring appropriate testing and treatment of the worker.

Needle stick incidents are possible when the needle of the syringe is exposed by the health care worker in order to collect the body fluid sample. Various devices have been developed to help a professional avoid needle sticks. For example, U.S. Pat. No. 5,624,404 discloses a hand held phlebotomy protection device that holds at least three test tubes. This device is held in the hand of a phlebotomist as the professional makes his or her patient rounds collecting body fluids. The device teaches a shield disk supported by a resilient handle that holds the test tubes within the handle. Both the handle and the shield disk are designed to protect the hand holding the device from needle sticks.

Other devices have been invented for use in the transfer of body fluids to test tubes which are not hand held. For example, U.S. Pat. No. 5,217,694 illustrates another device for holding test tubes which allows a plurality of test tubes of varied sizes to be automatically fed to an insertion point where the health care worker can insert and remove a hypodermic needle tipped syringe without holding the test tube or the holder by hand. This holder has a flap at the front top end of the device with a series of holes across it for inserting and removing a needle through to a test tube beneath. This device automatically advances test tubes from the back to the front of the device where the needle is inserted into the tube.

Still, there remains a need to provide a device that is lightweight and can be easily fitted onto a phlebotomist's tray, permitting the worker to fill one or more test tubes from a body fluid sample with one hand, while still protecting the worker from needle sticks. By providing multiple test tubes, the device accommodates the physician ordering a variety of tests that require a variety of test tubes. The device is simple to use, as well as economical to manufacture and to provide at a reasonable price to the consumer. Furthermore, the device is useful in a laboratory as well as on a phlebotomist's or similar tray.

SUMMARY OF THE INVENTION

The above needs are accomplished by the present invention through a portable liquid transfer device able to fit onto a phlebotomist's tray and equipped with a top lid with guide holes for guiding a needle-tipped syringe into test tube carried below. The device is able to support multiple test tubes of varying sizes. The top lid of the device is slidably removable for the easy placement and removal of test tubes.

More specifically, the present invention involves a bottomless liquid transfer device for carrying at least one test tube for receiving fluids transferred from a needle-tipped syringe. The device comprises a carrier with at least one hole for supporting at least one test tube for receipt of the fluids, wherein the test tube is supported in the hole at the open end of the test tube. The device also has a top with at least one guide aperture substantially aligned above the carrier hole for directing a needle into a test tube supported by the carrier. In addition, the carrier has at least three sides whose top edges create a protective lip above said top, wherein the lip aids in preventing a misdirected needle from injuring a worker.

The present invention is also directed to a new method for safely transferring fluids from a needle-tipped syringe to at least one test tube, comprising the steps of providing a liquid transfer device comprising a carrier that holds at least one test tube at the open end of the test tube in upright suspension; a guide with at least one aperture aligned above the carrier that is positioned to direct a syringe needle into the test tube; and a protective lip around the top of the device; loading at least one test tube into the carrier; guiding a needle of a syringe through the guide aperture; transferring the fluid in the syringe through the needle into the test tube; and removing the needle and syringe.

Among those benefits and improvements that have been disclosed, other objects and advantages of this invention will become apparent from the following description taken in conjunction with the accompanying drawings. The drawings constitute a part of this specification and include exemplary embodiments of the present invention and illustrate various objects and features thereof.

DESCRIPTION OF THE INVENTION

Figure 1:
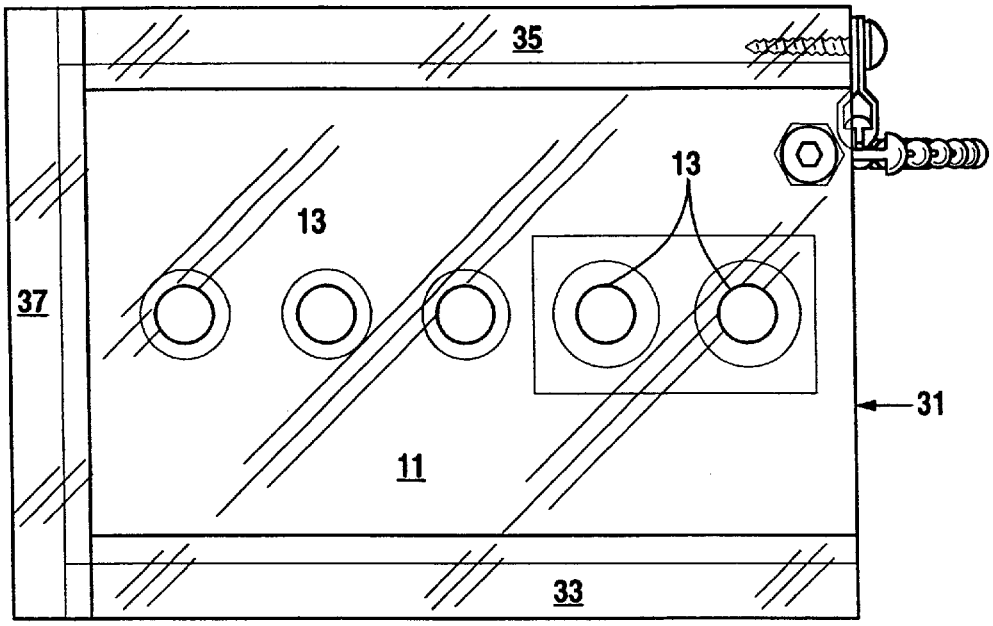
FIG. 1 is a top plan view of the invention.
Figure 2:
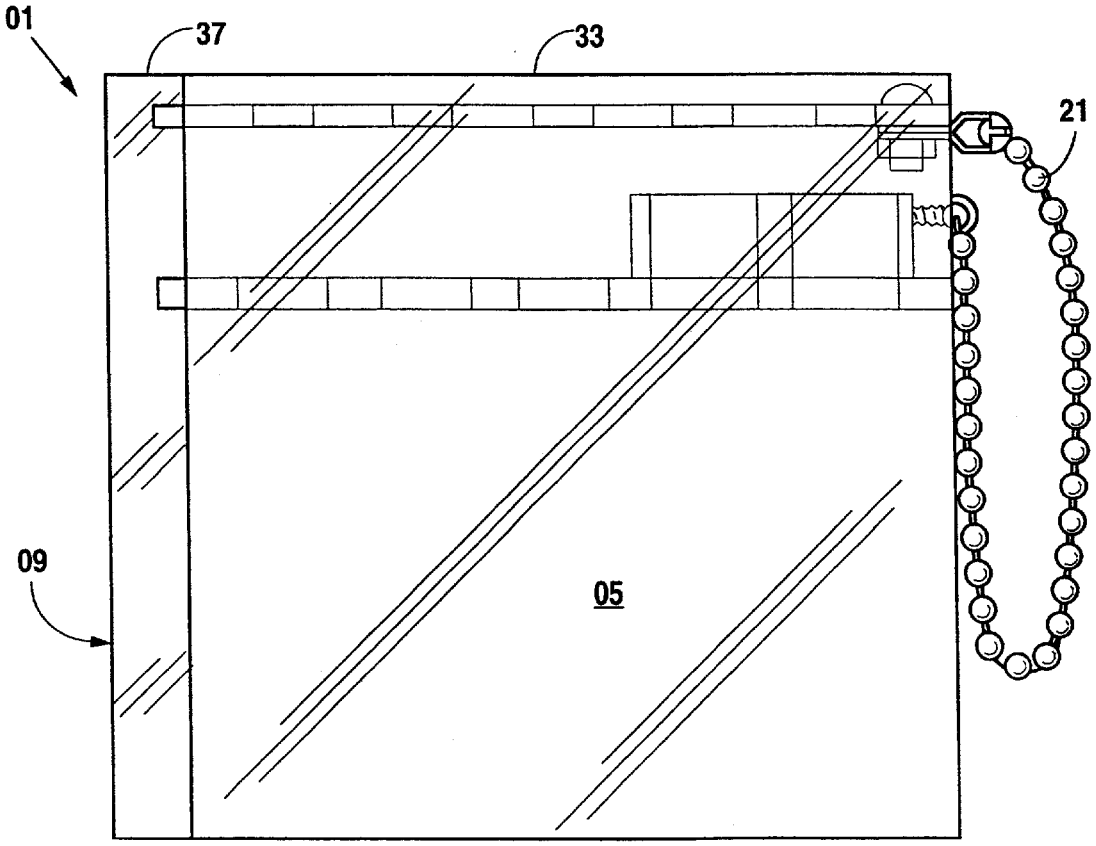
FIG. 2 is a left side elevation view of the invention.
Figure 3:
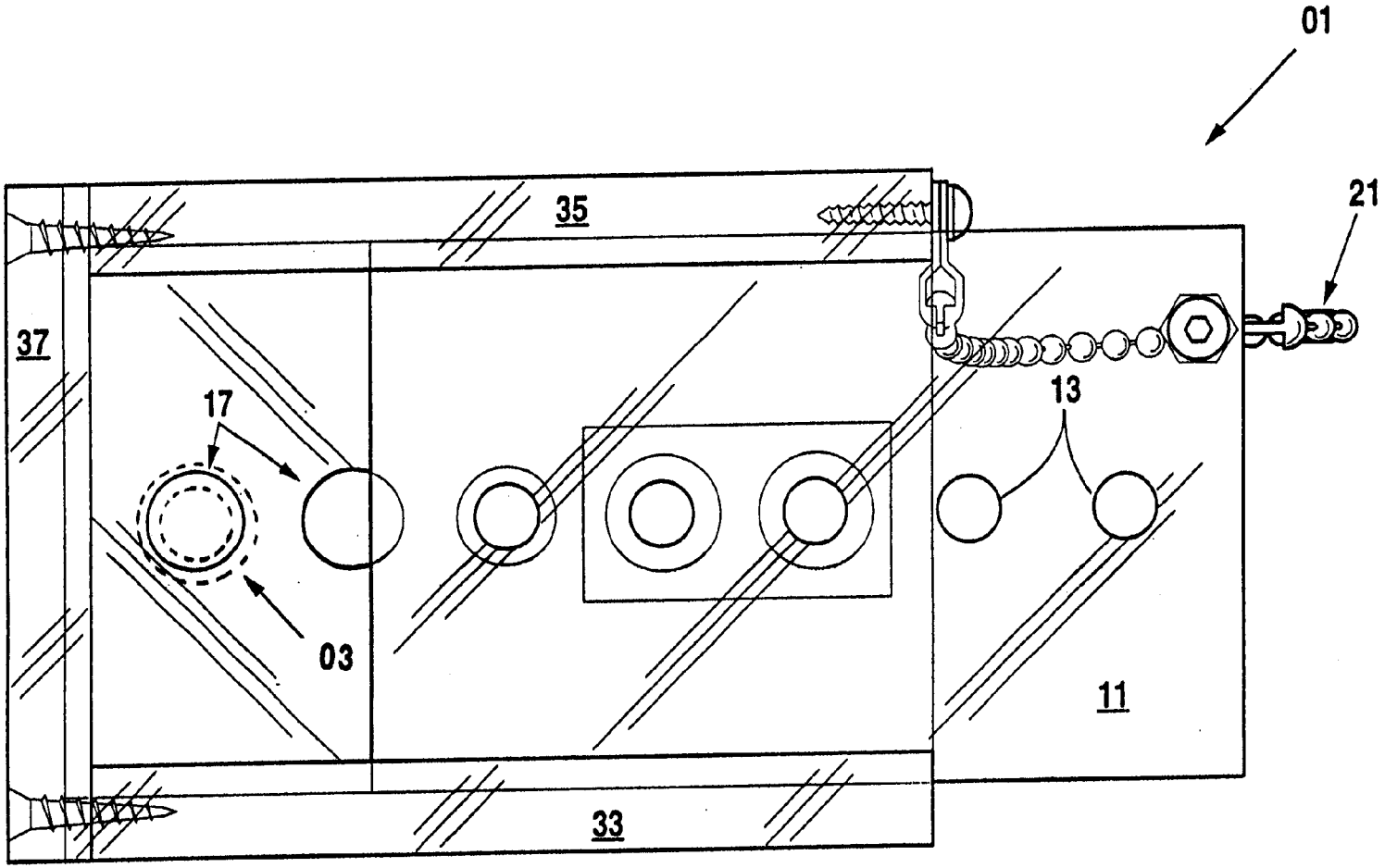
FIG. 3 is a top plan view of the invention with the lid partially removed.
Figure 4:
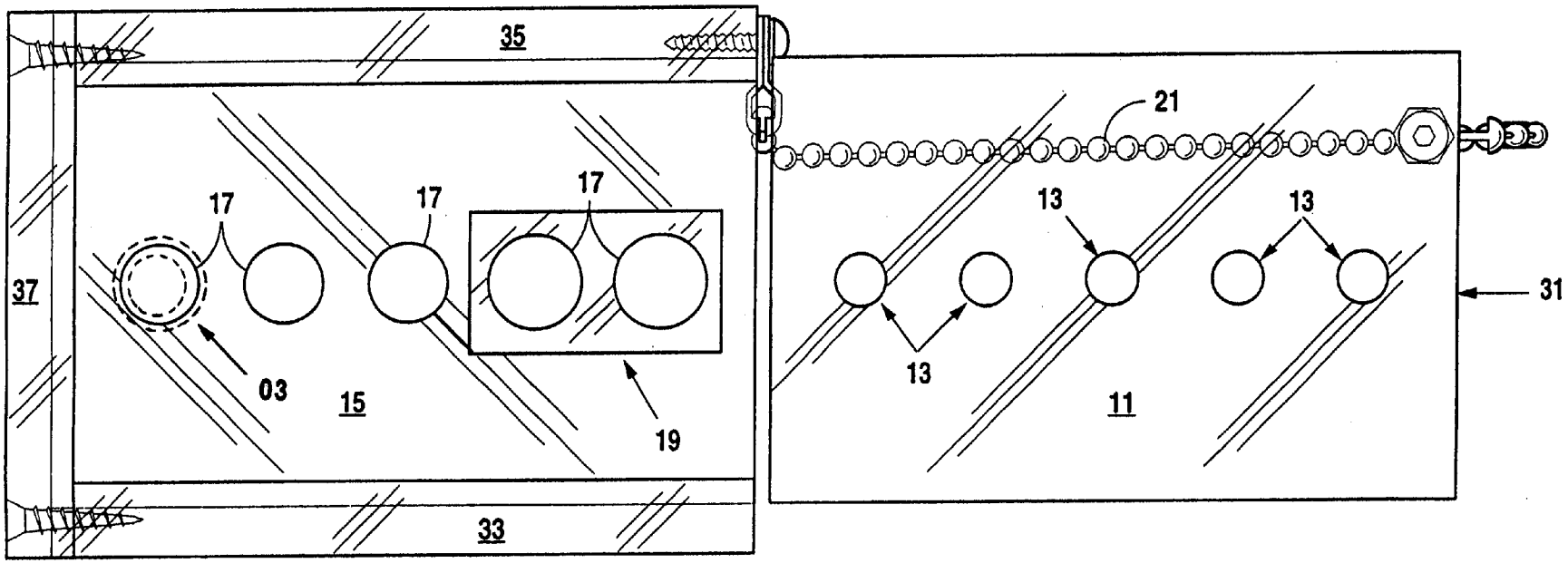
FIG. 4 is a top plan view of the invention with the lid completely removed.
Figure 5:
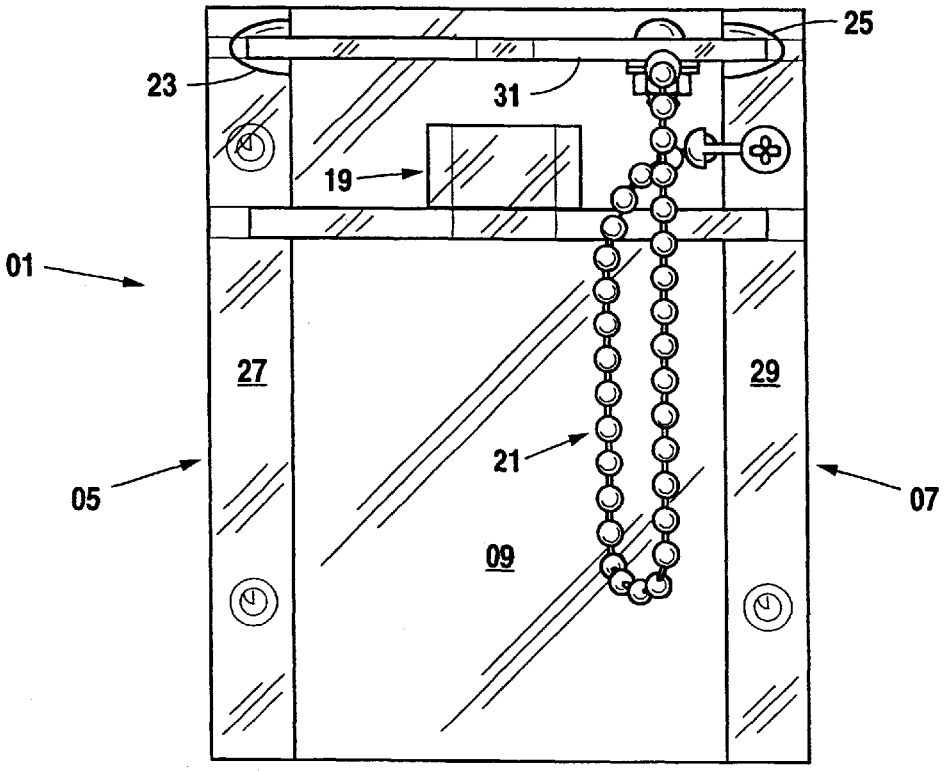
FIG. 5 is a front elevation view of the invention.
Figure 6:
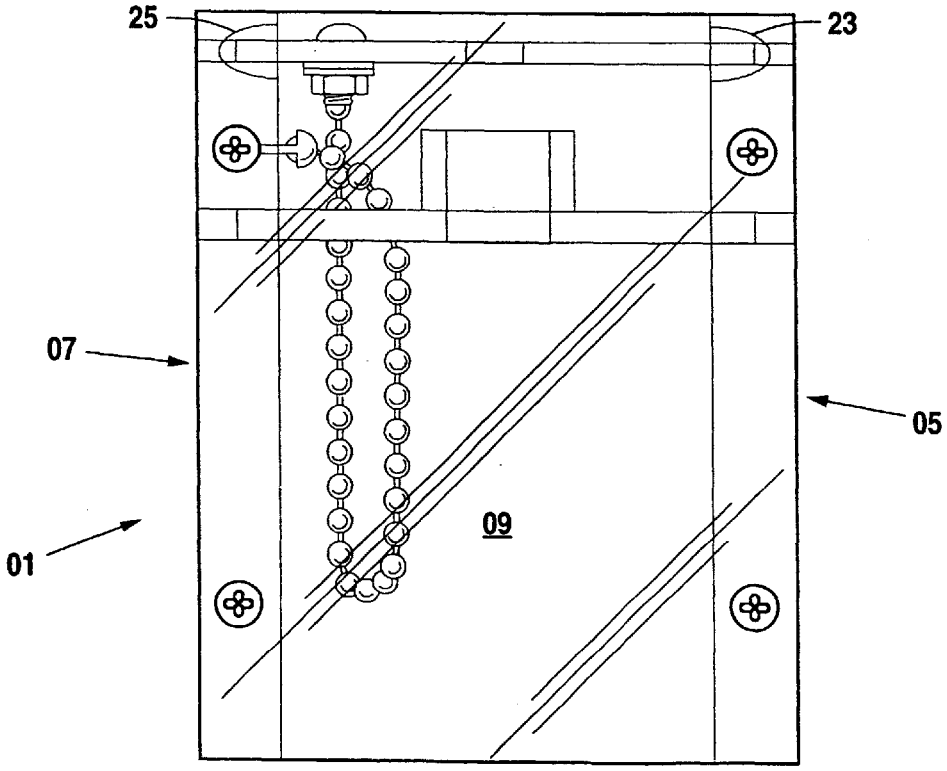
FIG. 6 is a rear elevation view of the invention.

An exemplary embodiment of the present invention is illustrated in FIGS. 1 through 6. As illustrated, the present invention is a liquid transfer device or holder 01 having a plurality of apertures 17 for carrying one or more test tubes 03 of varying sizes. The device 01 includes a slidable guide 11 with a plurality of guide apertures 13 which serve in directing a needle into the top of a test tube 03 for receiving a liquid from a syringe. The device 01 is of such size and weight as to be portable and utilized on the tray of a health care professional.

More specifically, the holder 01 establishes a three-sided box that includes a vertical first side 05, a second side 07 and a third side or back wall 09, found extending between the first side 05, second side 07. The first and second sides 05 and 07 have a groove or track 23, 25 for slidably receiving the guide 11. This slidably removable guide lid 11, when positioned within the grooves 23, 25 for use by a health care professional, extends horizontally forward from the back wall or side 09 and along the lengths of the sides 05, 07. In this position, the forward edge 31 of the guide lid 11 preferably is even with the forward edges 27, 29 of the sides 07, 09. When placed within the grooves 23, 25 of the sides 05, 07, the guide lid 11 is preferably positioned near the top edges 33, 35, 37 of the sides 05, 07, 09. In one embodiment, a lock is available for securing the lid 11 in place for use.

The top edges 33, 35, 37 of the sides 05, 07, 09 create a protective lip 39 around the inside of the guide of the sides 05, 07, 09 with the top 11 placed in the holder 01. This lip 39 aids in preventing errant needles from sliding off the device 01 and onto the tray carrying the device 01 or injuring or puncturing a worker.

Also positioned horizontally within the holder 01 is a carrier 15 for supporting or holding one or more cylindrical tubes 03. This carrier or shelf 15 is positioned below and parallel to the guide 11 and is preferably permanently fixed to the vertical sides 05, 07, 09 whereby the carrier 15 holds upright the tubes 03. The sides 05, 07, 09 and the carrier 15 may be secured to one another by various means including screws, glue, rivets, or any combination of similar means, or may be extruded as one solid piece. The guide 11 is attached to a chain or connector 21 by means of a bolt or rivet or similar means, and the link 21 is then attached to the holder 01 by like means. In another embodiment, the guide lid 11 may be permanently attached to the sides 05, 07 and 09 and the carrier 15 able to be slidably removed.

Found on the top side of the shelf 15 is a platform or elevation 19 for holding test tubes with necks shorter than standard tubes. This platform 1 9 is illustrated in FIGS. 2, 5, 6–9, 11 and 12.

In its preferred embodiment, the holder 01 is of a clear or light colored plastic that is easily cleaned and sterilized. At least the guide 11 should be of a clear plastic for indication of whether the carrier 15 has test tubes 03 in it. The connector 21 preferably should be stainless steel or like material that is not prone to rust from cleaning and is able to be autoclaved.

The carrier 15 has a plurality of carrier apertures or holes 17 for carrying one or more test tubes 03. Although illustrated as having the same diameter, it should be understood that the carrier holes 17 may be of various diameters so that a variety of sizes of test tubes 03 may be accommodated and supported by the carrier 15. Test tubes 03 utilized by health care professionals typically range in outside diameter from about 1.2 centimeters to about 1.6 centimeters. Preferably, the carrier holes 17 would be of various diameters in order to allow test tubes 03 of the above range of sizes to pass through.

A rubber stopper found on the end of the test tube 03 is typically of a larger outside diameter than the diameter of the carrier holes 17. This stopper portion will not pass through the hole 17, thereby allowing the tube 03 to rest on the carrier 15. Test tubes 03 without a rubber stopper typically have a flange or lip at the open end of the tube 03 of greater diameter than the length of the tube 03. This flange would also be of greater diameter than the hole 17 thereby preventing the tube 03 from passing completely through and allowing the tube 03 to be supported at an elevation by the carrier 15.

Located on the guide 11 of the device 01 are a plurality of guide apertures 13. These apertures 13 assist the health care professional in guiding or directing a needle attached to a syringe to a test tube 03 carried by the carrier 15 or platform 19 and located below the aperture 13. The apertures 13 are positioned on the guide lid 11 so that each one is aligned with a carrier hole 17 directly beneath it.

The transfer apparatus or device 01 may be equipped with suction cups, VELCRO or other adhesive securers found on the bottom of the sides 05, 07 and 09 for securing the holder 01 to a tray carried by a health care professional or other surface. These keep the device 01 in position while in use by the professional and prevent it from sliding on the surface.

Figure 7:
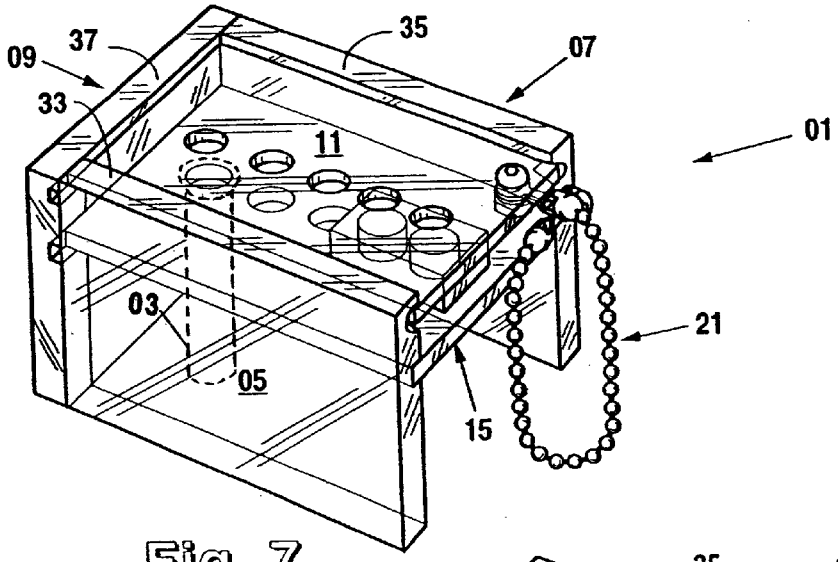
FIG. 7 is a perspective view of one embodiment of the present invention with the slidable top installed within the apparatus.
Figure 8:
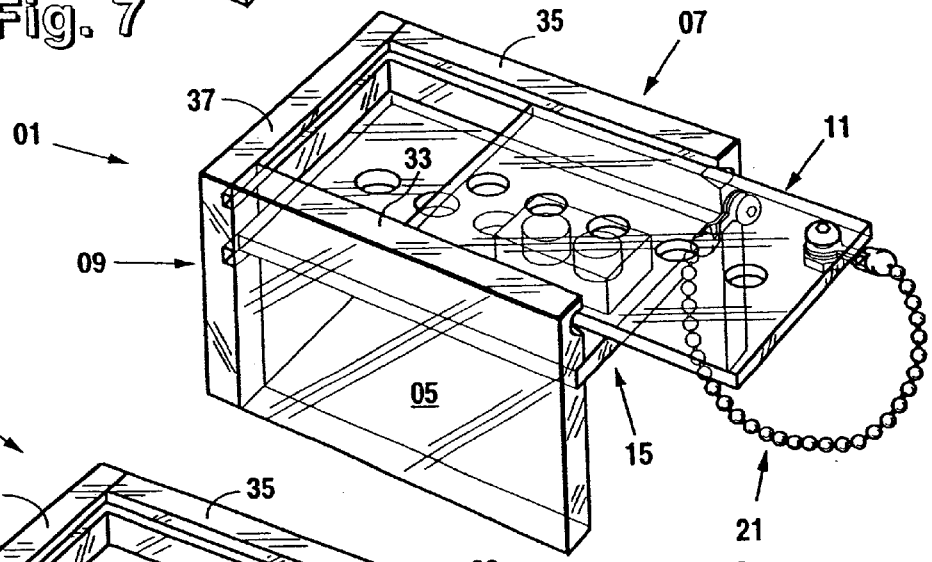
FIG. 8 is a perspective view of the present invention with the slidable top partially removed from the apparatus.
Figure 9:
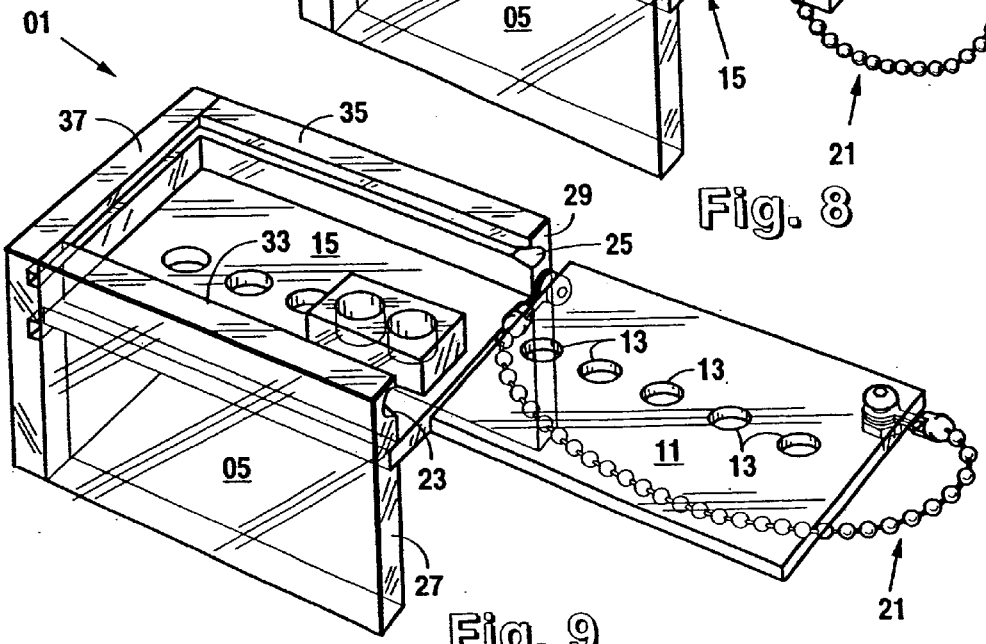
FIG. 9 is a perspective view of the present invention with the slidable top completely removed from the apparatus.
Figure 10:
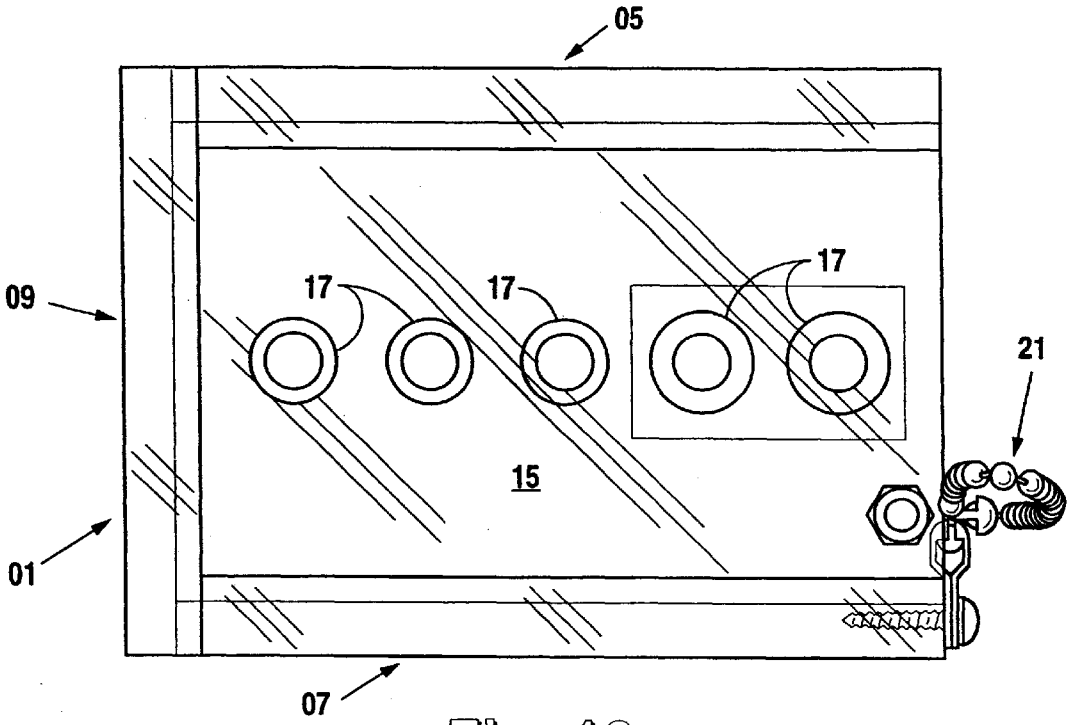
FIG. 10 is a bottom plan view of the invention.
Figure 11:
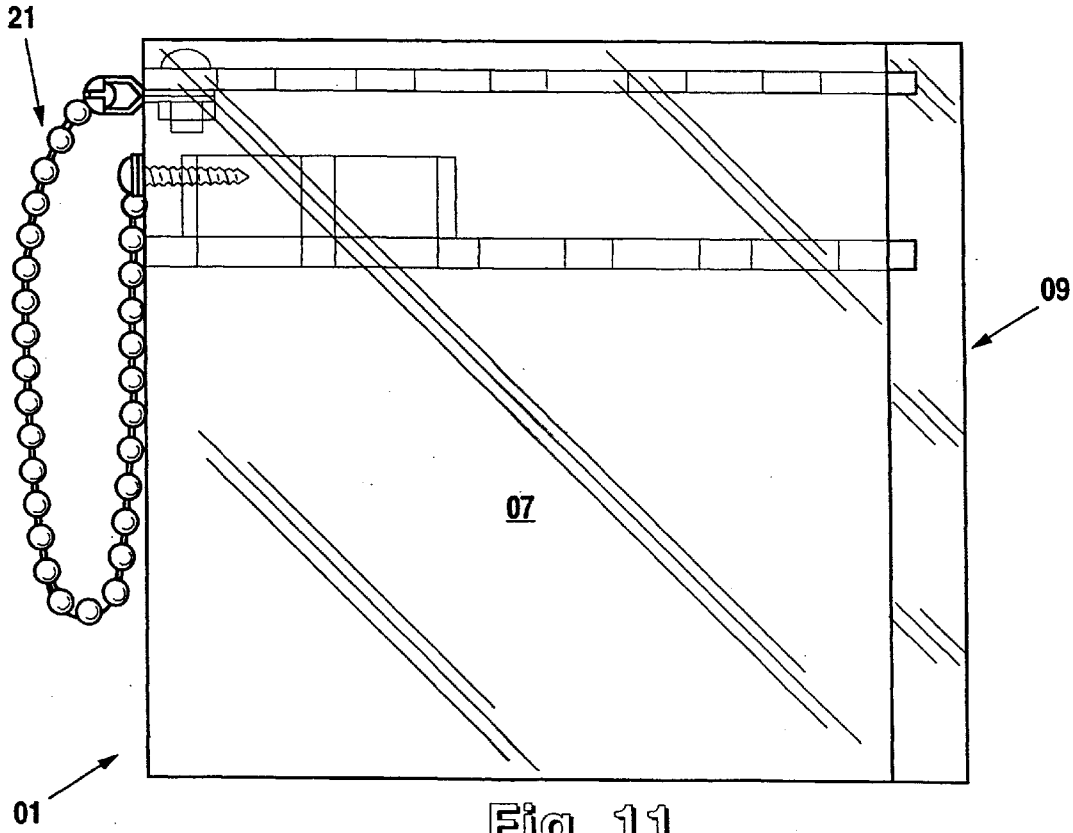
FIG. 11 is a right side elevation view of the invention.
Figure 12:
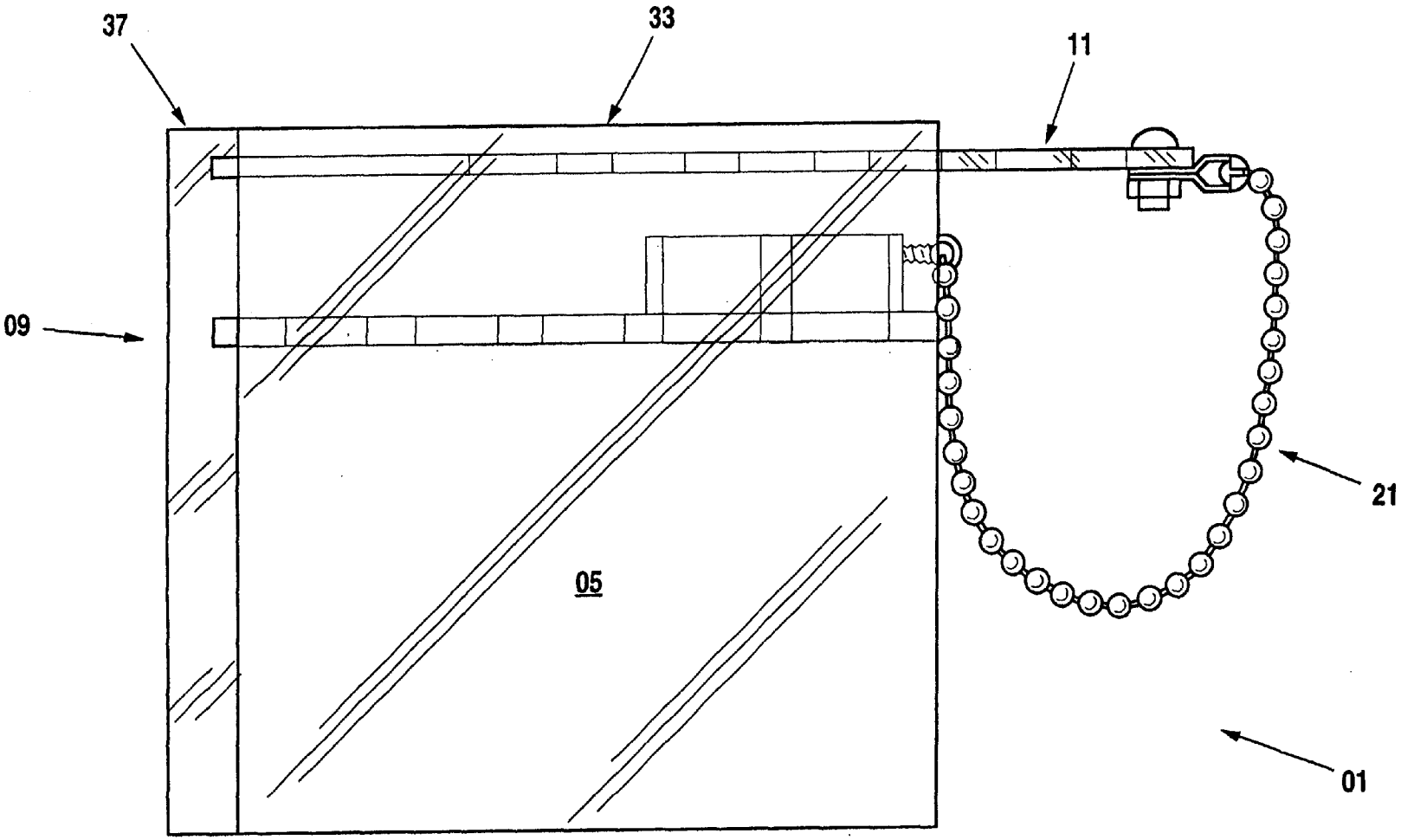
FIG. 12 is a left side elevation view of the invention with the slidable top partially removed.

Use of the device 01 is as follows. The guide lid 11 is slidably removed from the holder 01 as illustrated in FIGS. 7 through 9. According to the need of the health care worker, one or more test tubes 03 are then placed into a carrier hole 17 on the shelf 15. With the tubes 03 in place, the guide 11 is placed back within the device 01 as illustrated in FIG. 7.

Once a blood sample or other liquid sample is taken from a patient with a hypodermic needle syringe, the health care professional can then transfer the sample using one hand through a guide hole 13 into one or more of the test tubes 03 held by the carrier 15 in one of its test tube carrier holes 17. After transfer, the needle and syringe are then removed to be discarded.

With the test tubes 03 filled, the guide 11 is again slidably removed from the holder 01 allowing the worker to remove the tubes 03 for labeling and preparation for lab work. The worker can then place one or more tubes 03 into the holder 01 for collecting liquid samples from the next patient. It should be noted that the apparatus can also be utilized in a lab to help prevent a lab technician from being injured by a needle.

As described above, the concepts embodied in the present invention permit a simplistic construction that may be relatively inexpensively manufactured and suitable for home use too. Variations on the exact construction may occur, but still be within the spirit and disclosure of the invention's scope.

What is claimed and desired to be secured by Letters Patent is as follows:

1. A bottomless liquid transfer device for carrying at least one test tube for receiving fluids transferred from a needle-tipped syringe, said liquid transfer device comprising:

a carrier with at least one hole for supporting at least one test tube for receipt of the fluids, wherein the test tube is supported in the hole at the open end of the test tube;

a guide with at least one guide aperture substantially aligned above the carrier hole for directing a needle into a test tube supported by the carrier; and at least three sides situated about said carrier and said guide whose top edges create a protective lip above said top, said lip aiding in the prevention of misdirected needles.

2. The transfer device as claimed in claim 1 wherein said carrier holes are of varying diameters to accommodate test tubes of varying diameters.

3. The transfer device as claimed in claim 1 wherein said guide is slidably removable in a substantially horizontal direction from said device for the placement of test tubes into the device and removal of test tubes from the device.

4. The transfer device as claimed in claim 3 further comprising:

a link for securing said guide to the device when said guide is removed from the device.

5. The transfer device as claimed in claim 1 further comprising:

a securer wherein said device is able to be secured to a surface thereby keeping the device in position while in use.

6. The transfer device as claimed in claim 1 further comprising:

a platform placed on said carrier for elevating at least one test tube such that the open end of the test tube is located closer to the guide aperture.

7. The transfer device as claimed in claim 1, wherein the test tube is supported in said hole of said carrier by a flange portion of the open end of the test tube.

8. The transfer device as claimed in claim 1, wherein the test tube is supported in said hole of said carrier by a rubber stopper attached to the open end of the test tube.

9. A holder for safely transferring fluids from a needle-tipped syringe to at least one test tube comprising:

a carrier for supporting at an elevation the test tube on said holder;

at least three sides for elevating said carrier thereby allowing the test tube to be positioned upright for receipt of fluids; and a guide with at least one guide hole for directing the needle of a syringe into a test tube supported by said carrier and positioned beneath said hole of said guide, wherein said guide is positioned beneath the top edge of said sides to create a protective lip for preventing straying of errant needles and wherein said sides are situated about said carrier and said guide.

10. The holder as claimed in claim 9 wherein said carrier further comprises a platform placed on said carrier for elevating at least one test tube such that the open end of the test tube is placed closer to the guide hole.

11. The holder as claimed in claim 9 wherein said guide hole is substantially aligned with the open end of a test tube supported by the carrier.

12. The holder as claimed in claim 9 wherein said top is slidably receivable by the device thereby permitting placement into and removal from the carrier of test tubes for receiving fluid samples.

13. The holder as claimed in claim 12 wherein said sides further comprise a recess for receiving said guide into said device in a substantially horizontally direction.

14. The holder as claimed in claim 9 further comprising a securer for securing said holder to a surface.

15. A bottomless liquid transfer device for carrying at least one test tube for receiving fluids transferred from a needle-tipped syringe, said liquid transfer device comprising:

a carrier with at least one hole for supporting at least one test tube for receipt of the fluids, wherein the test tube is supported in the hole at the open end of the test tube;

a guide with at least one guide aperture substantially aligned above the carrier hole for directing a needle into a test tube supported by the carrier, wherein said guide is slidably removable from said device for the placement of test tubes into the device and removal of test tubes from the device;

a link for securing said guide to the device when said guide is removed from the device; and at least three sides situated about said carrier and said guide whose top edges create a protective lip above said top, wherein said lip aids in preventing a misdirected needle from injuring a worker.

16. A method for safely transferring fluids from a needle-tipped syringe to at least one test tube, comprising the steps of:

providing a liquid transfer device comprising:

a carrier with at least one hole for supporting at least one test tube at an elevation in said device;

at least three sides for elevating said carrier thereby allowing said test tube to be positioned upright for receipt of fluids; and a guide with at least one guide hole for directing the needle of a needle-tipped syringe into a test tube supported by said carrier and positioned beneath said guide hole of said guide;

wherein said guide is positioned beneath the top edge of said sides thereby creating a protective lip for preventing straying of errant needles and wherein said sides are situated about said carrier and said guide;

slidably removing the guide from the carrier:

placing at least one test tube into a carrier hole;

slidably positioning said guide over the carrier;

guiding a needle of a syringe through a guide hole of said guide;

transferring the fluid in said syringe through said needle into said test tube; and removing said needle and syringe.

17. The method of claim 16, further comprising reloading the carrier with empty test tubes, comprising the steps of:

slidably removing the guide from the carrier;

removing said test tubes that are filled with fluid;

placing at least one empty test tube into a carrier hole; and slidably positioning the guide over the carrier, creating a protective lip above said guide, wherein said lip aids in preventing a misdirected needle from injuring a worker.

18. The method of claim 16, further comprising:

securing said liquid transfer device to a surface during use.

19. The method of claim 16, further comprising:

transporting said liquid transfer device with at least one fluid-filled test tube to a laboratory for processing of said fluid.

20. A method for safely transferring fluids from a syringe to at least one test tube, which comprises:

(a) providing a liquid transfer device comprising:

a carrier that holds at least one test tube at the open end of said test tube in upright suspension;

a guide with at least one guide aperture; and at least three sides whose top edges form a protective lip around the top of said device;

(b) removing said guide from said device;

(c) loading at least one test tube into said carrier;

(d) inserting said guide within said device with at least one said aperture aligned above said carrier such that said aperture is positioned to direct a syringe needle into said test tube;

(e) guiding a needle of a syringe through said guide aperture;

(f) transferring the fluid in said syringe through said needle into said test tube; and (g) removing the needle and syringe.

* * * * *